US006213662B1

(12) United States Patent
Aljanedi

(10) Patent No.: US 6,213,662 B1
(45) Date of Patent: Apr. 10, 2001

(54) TOOTHBRUSH WITH PASTE DISPENSER

(76) Inventor: Mohdsameer Y Aljanedi, 4626 Via Marina #103, Marina Del Ray, CA (US) 90292

( * ) Notice: Subject to any disclaimer, the term of this patent is extended or adjusted under 35 U.S.C. 154(b) by 0 days.

(21) Appl. No.: 09/580,912

(22) Filed: May 26, 2000

Related U.S. Application Data

(63) Continuation-in-part of application No. 09/311,412, filed on May 13, 1999, now abandoned.

(51) Int. Cl.[7] ..... B43K 5/06

(52) U.S. Cl. ..... 401/175; 401/174; 401/277; 401/172

(58) Field of Search ..... 401/175, 174, 401/173, 172, 171, 270, 275, 277, 282

(56) References Cited

U.S. PATENT DOCUMENTS

| | | |
|---|---|---|
| D. 378,957 | 4/1997 | Turner et al. . |
| 919,440 | 4/1909 | Lawson et al. . |
| 1,362,937 | 12/1920 | Grace . |
| 2,917,057 | 12/1959 | Busseuil . |
| 4,277,194 | 7/1981 | Smith . |
| 4,291,995 | 9/1981 | Dikoff . |
| 4,890,732 | 1/1990 | Shackelford . |
| 5,066,155 | 11/1991 | English et al. . |

FOREIGN PATENT DOCUMENTS

| | | |
|---|---|---|
| 149126 | 4/1937 | (AT) . |
| 526405 | 2/1954 | (BE) . |
| 2207640 | 2/1999 | (GB) . |
| 52-51251 | 4/1977 | (JP) . |
| 300537 | 10/1954 | (SZ) . |

*Primary Examiner*—David J. Walczak

(57) ABSTRACT

A toothbrush with paste dispenser for brushing teeth. The toothbrush with paste dispenser includes a housing with a reservoir portion and a head portion extending from the reservoir portion. The reservoir portion has toothpaste therein. The head portion has a plurality of bristles coupled to a bristled portion thereof. The head portion has a tube extending therethrough an opening in the bristled portion and in communication with the reservoir portion. The toothpaste is forced through the tube such that a portion of the toothpaste and dispensed onto the bristles. An ejection assembly ejects the toothpaste from the reservoir portion.

8 Claims, 3 Drawing Sheets

TOOTHBRUSH WITH PASTE DISPENSER

CROSS REFERENCE TO RELATED APPLICATION

This application is a continuation-in-part of my application, Ser. No. 09/311,412, filed May 13, 1999.

BACKGROUND OF THE INVENTION

1. Field of the Invention

The present invention relates to toothbrushes and more particularly pertains to a new toothbrush with paste dispenser for brushing teeth.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,066,155; 4,291,995; 1,362,937; 4,277,194; 4,890,732; and Des. 378,957.

While these devices fulfill their respective, particular objectives and requirements, the aforementioned patents do not disclose a new toothbrush with paste dispenser. The inventive device includes a housing with a reservoir portion and a head portion extending from the reservoir portion. The reservoir portion has toothpaste therein. The head portion has a plurality of bristles coupled to a bristled portion thereof. The head portion has a tube extending therethrough an opening in the bristled portion and in communication with the reservoir portion. The toothpaste is forced through the tube such that a portion of the toothpaste and dispensed onto the bristles. An ejection means ejects the toothpaste from the reservoir portion.

In these respects, the toothbrush with paste dispenser according to the present invention substantially departs from the conventional concepts and designs of the prior art, and in so doing provides an apparatus primarily developed for the purpose of brushing teeth.

SUMMARY OF THE INVENTION

In view of the foregoing disadvantages inherent in the known types of toothbrushes now present in the prior art, the present invention provides a new toothbrush with paste dispenser construction wherein the same can be utilized for brushing teeth.

The general purpose of the present invention, which will be described subsequently in greater detail, is to provide a new toothbrush with paste dispenser apparatus and method which has many of the advantages of the toothbrushes mentioned heretofore and many novel features that result in a new toothbrush with paste dispenser which is not anticipated, rendered obvious, suggested, or even implied by any of the prior art toothbrushes, either alone or in any combination thereof.

To attain this, the present invention generally comprises a housing with a reservoir portion and a head portion extending from the reservoir portion. The reservoir portion has toothpaste therein. The head portion has a plurality of bristles coupled to a bristled portion thereof. The head portion has a tube extending therethrough an opening in the bristled portion and in communication with the reservoir portion. The toothpaste is forced through the tube such that a portion of the toothpaste and dispensed onto the bristles. An ejection means ejects the toothpaste from the reservoir portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new toothbrush with paste dispenser apparatus and method which has many of the advantages of the toothbrushes mentioned heretofore and many novel features that result in a new toothbrush with paste dispenser which is not anticipated, rendered obvious, suggested, or even implied by any of the prior art toothbrushes, either alone or in any combination thereof.

It is another object of the present invention to provide a new toothbrush with paste dispenser which may be easily and efficiently manufactured and marketed.

It is a further object of the present invention to provide a new toothbrush with paste dispenser which is of a durable and reliable construction.

An even further object of the present invention is to provide a new toothbrush with paste dispenser which is susceptible of a low cost of manufacture with regard to both materials and labor, and which accordingly is then susceptible of low prices of sale to the consuming public, thereby making such toothbrush with paste dispenser economically available to the buying public.

Still yet another object of the present invention is to provide a new toothbrush with paste dispenser which provides in the apparatuses and methods of the prior art some of the advantages thereof, while simultaneously overcoming some of the disadvantages normally associated therewith.

Still another object of the present invention is to provide a new toothbrush with paste dispenser for brushing teeth.

Yet another object of the present invention is to provide a new toothbrush with paste dispenser which includes a housing with a reservoir portion and a head portion extending from the reservoir portion. The reservoir portion has toothpaste therein. The head portion has a plurality of bristles coupled to a bristled portion thereof. The head portion has a tube extending therethrough an opening in the bristled portion and in communication with the reservoir portion. The toothpaste is forced through the tube such that a portion of the toothpaste and dispensed onto the bristles. An ejection means ejects the toothpaste from the reservoir portion.

Still yet another object of the present invention is to provide a new toothbrush with paste dispenser that may be disposable, thereby urging the user to replace the toothbrush when all of the paste is gone rather than using the toothbrush after the bristles begin to lose effectiveness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
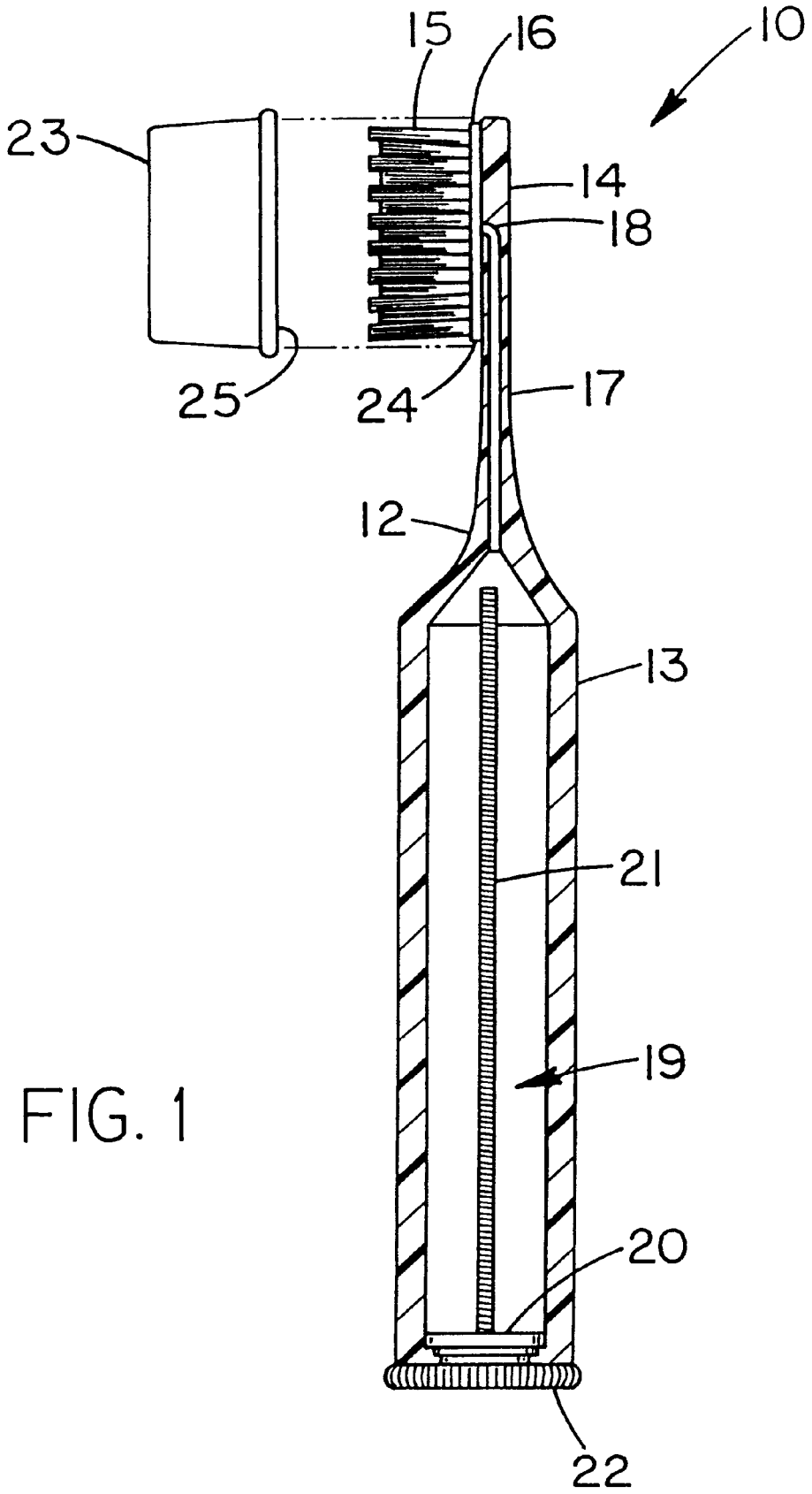
FIG. 1 is a schematic cross sectional view of a new toothbrush with paste dispenser according to the present invention.

With reference now to the drawings, and in particular to FIGS. 1 through 5 thereof, a new toothbrush with paste dispenser embodying the principles and concepts of the present invention and generally designated by the reference numeral 10 will be described.

As best illustrated in FIGS. 1 through 5, the toothbrush withpaste dispenser 10 is disposable and generally comprises a a housing 12 with a reservoir portion 13 and a head portion 14 extending from the reservoir portion. The reservoir portion has toothpaste therein. The head portion has a plurality of bristles 15 coupled to a bristled portion 16 thereof. The head portion has a tube 17 extending therethrough an opening 18 in the bristled portion and in communication with the reservoir portion. The toothpaste is forced through the tube such that a portion of the toothpaste and dispensed onto the bristles. An ejection means 19 ejects the toothpaste from the reservoir portion.

Preferably, the ejection means comprises a holed disc 20 nonrotatably and slidably positioned in the reservoir portion and engaging the toothpaste. A threaded shaft 21 threadedly engages the holed disc and extends from a bottom of the reservoir portion towards the head portion. A turn handle 22 is operatively coupled to the threaded shaft. The turn handle rotates the threaded shaft for selectively positioning the holed disc along the threaded shaft. The holed disc engages an inner surface of the reservoir portion for forming a seal therewith.

Preferably, a first bristle cover 23 is removably coupled to the bristled portion. The bristled portion of the housing has a peripheral edge 24. The first bristle cover has a peripheral groove 25 extending around an outer rim thereof. The peripheral groove is adapted for receiving the peripheral edge of the bristled portion for frictionally holding the first bristle cover on the bristled portion.

The preferred longitudinal length of the reservoir portion is about 6½ inches. The preferred dimensions of the bristled portion is about 1 inch long by about ¼ to ⅓ inch wide. The preferred distance from the reservoir portion to the bristled portion is about 2 inches. The preferred outer diameter of the turn handle is about ½ inch.

In use, turn handle is rotated in a first direction with respect to the reservoir portion to move the holed disc towards the head portion, thereby forcing toothpaste out into the bristled portion.

Figure 4:
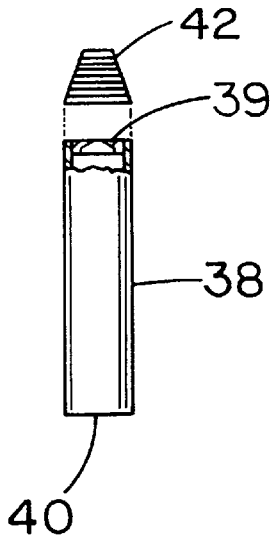
FIG. 4 is a schematic side view of a toothpaste cartridge of the present invention.
Figure 3:
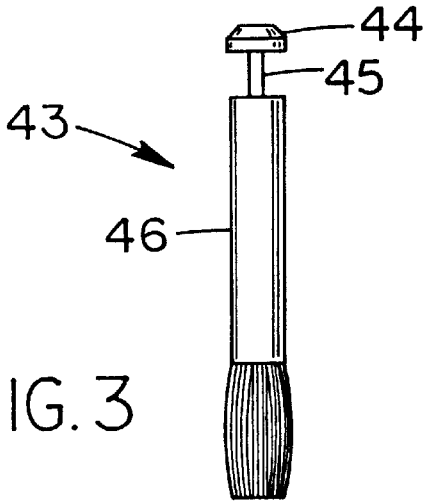
FIG. 3 is a schematic side view of a plunger of the present invention.
Figure 2:
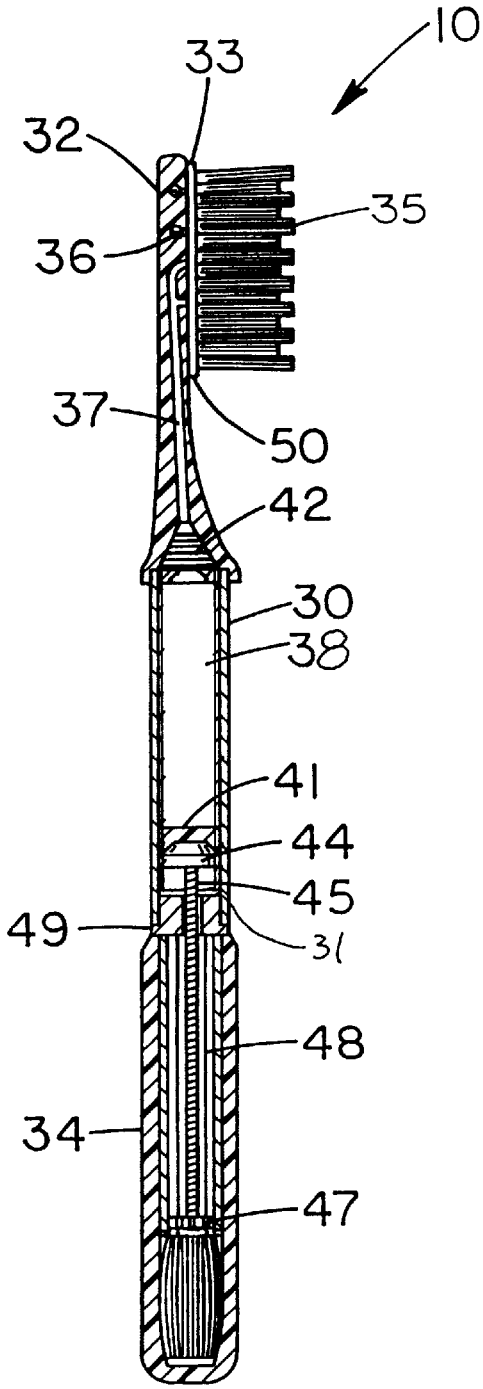
FIG. 2 is a schematic cross sectional view of an alternate embodiment of the present invention.
Figure 5:
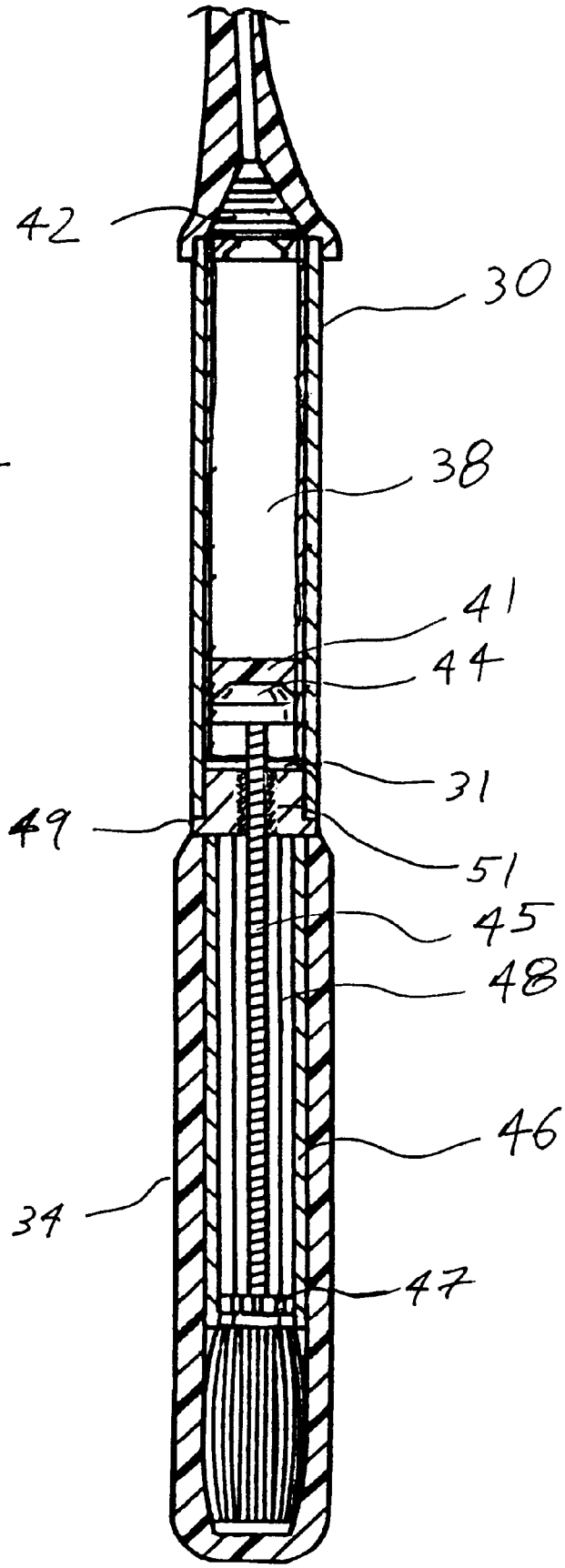
FIG. 5 is an enlarged schematic cross-sectional view of the ejection means of the present invention.

In a second embodiment, shown in FIG. 2 through FIG. 4, the toothbrush is refillable. The toothbrush has housing 30 with a reservoir portion 31, a head portion 32 detachably coupled to the reservoir portion, a bristled portion 33 detachably coupled to the head portion, and a handle portion 34 rotatably coupled to the reservoir portion.

The bristled portion has a plurality of bristles 35 fixedly coupled thereto. The bristled portion may have a plurality of bulbous protuberances 36 extending from it that fit into similarly shaped apertures in the head portion to detachably attach the bristled portion to the head portion.

The head portion has a tube 37 extending therethrough having an opening in a central portion of the bristled portion and in communication with the reservoir portion. The toothpaste is forcible through the tube such that a portion of the toothpaste is dispensible onto the bristles.

A cartridge 38 has an open top 39, an open bottom 40, toothpaste disposed therein, and an abutment disc 41 positioned towards the bottom and engaging the toothpaste. The cartridge is disposable in the reservoir portion such that the open top is positioned towards the tube of the head portion.

Preferably, a generally conical resiliently deformable rubber seal 42 member is positioned in the tube and engages the open top of the cartridge for forming a seal between the open top of the cartridge and the tube. The seal comprises a bore therethrough for allowing passage of the toothpaste through the seal.

An ejection means 43 ejects the toothpaste from the cartridge. Preferably, the ejection means comprises a plunger 44 slidably positioned in the reservoir portion and engaging the abutment disc of the cartridge. A threaded shaft 45 is coupled to the plunger and extends from the reservoir portion into the handle portion through a threaded aperture 51 in the reservoir portion.

A shaft housing 46 is fixedly disposed in the handle portion and nonrotatably engages the threaded shaft. The threaded shaft is slidably positionable along the shaft housing. One way of doing this is to have a pair of lateral flanges 47 extending from an end of the threaded shaft. The shaft housing would have channels 48 running along an inner surface of the shaft housing. When the handle portion is rotated the shaft housing is rotated such that the rotation of the shaft housing causes the later flanges to be rotated thereby causing the threaded shaft to rotate within the threaded aperture. The rotation of the threaded shaft in the threaded aperture causes lateral movement of the shaft thereby causing the plunger and later flanges to change position in relation to the threaded shaft.

Ideally, a friction ring 49 is positioned between the handle portion and the reservoir portion for resisting rotation of the reservoir portion with respect to the handle portion.

A second bristle cover maybe removably coupled to the bristled portion. Ideally, the bristled portion of the housing has a peripheral edge 50. The second bristle cover has a peripheral groove extending around an outer rim thereof. The peripheral groove is adapted for receiving the peripheral edge of the bristled portion for frictionally holding the first bristle cover on the bristled portion.

The preferred length of the handle and reservoir portions is about 6 inches. The preferred dimensions of the bristled portion is about 1 inch long by about ¼ to ⅓ inch wide. The preferred distance from the reservoir portion to the bristled portion is about 2 inches. The preferred length of a cartridge is about 1½ inches. The preferred length of the shaft housing is about 2½ inches. The preferred outer diameter of the handle portion is about ½ inch.

In use, the handle portion is rotated in a first direction with respect to the reservoir portion to move the threaded shaft towards the head portion, thereby forcing toothpaste out of the cartridge. To replace the cartridge, the handle portion is rotated in a second direction with respect to the reservoir portion to move the threaded shaft away from the head portion. The head portion is removed and a full cartridge is inserted in the reservoir portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refillable toothbrush, comprising:

a housing having a reservoir portion, a head portion detachably coupled to said reservoir portion, a bristled portion, and a handle portion rotatably coupled to said reservoir portion;

said bristled portion having a plurality of bristles coupled thereto, said bristled portion may have a plurality of bulbous protuberances extending for detachably attaching said bristled portion to similarly apertures in said head portion of said housing;

said head portion having a tube extending therethrough having an opening in said bristled portion and in communication with said reservoir portion, said toothpaste being forcible through said tube such that a portion of said toothpaste is dispensible onto said bristles;

a cartridge having an open top, an open bottom, toothpaste disposed therein, and an abutment disc positioned towards said bottom and engaging said toothpaste, said cartridge being insertable in said reservoir portion such that said open top is positioned towards said tube of said head portion;

an ejection means for ejecting said toothpaste from said cartridge; and wherein a threaded shaft moves towards said head portion when said handle portion is rotated in a first direction with respect to said reservoir portion, said threaded shaft moving away from said head portion when said handle portion is rotated in a second direction.

2. The refillable toothbrush of claim 1, wherein said bristled portion is detachably coupled to said head portion.

3. The refillable toothbrush of claim 1, further comprising a generally conical resiliently deformable seal member positioned in said tube and engaging said open top of said cartridge for forming a seal between said open top of said cartridge and said seal member, wherein said seal has a bore therethrough for allowing passage of said toothpaste through said seal.

4. The refillable toothbrush of claim 1, wherein said ejection means comprises a plunger slidably positioned in said reservoir portion and engaging said abutment disc of said cartridge, a threaded shaft coupled to said plunger and extending from said reservoir portion into said handle portion through a threaded aperture in said reservoir portion, and a shaft housing fixedly disposed in said handle portion and nonrotatably engaging said threaded shaft, said threaded shaft being slidably positionable along said shaft housing.

5. The refillable toothbrush of claim 1, further comprising a friction ring positioned between said handle portion and said reservoir portion for resisting rotation of said handle portion with respect to said reservoir portion.

6. The refillable toothbrush of claim 1, further comprising a first bristle cover removably coupled to said bristled portion.

7. The tooth cleaning system of claim 6, wherein said bristled portion of said housing has a peripheral edge, said first bristle cover having a peripheral groove extending around an outer rim thereof, said peripheral groove being adapted for receiving said peripheral edge of said bristled portion for frictionally holding said first bristle cover on said bristled portion.

8. A toothbrush system, comprising:

a disposable toothbrush, comprising:

a housing having a reservoir portion and a head portion extending from said reservoir portion, said reservoir portion having toothpaste therein, said head portion having a plurality of bristles coupled to a bristled portion thereof;

said head portion having a tube extending therethrough having an opening in said bristled portion and in communication with said reservoir portion, said toothpaste being forcible through said tube such that a portion of said toothpaste is dispensible onto said bristles;

an ejection means for ejecting said toothpaste from said reservoir portion, said ejection means comprising a holed disc nonrotatably positioned in said reservoir portion and engaging said toothpaste, a threaded shaft threadedly engaging said holed disc and extending from a bottom of said reservoir portion towards said head portion, and a turn handle operatively coupled to said threaded shaft, said turn handle rotating said threaded shaft for selectively positioning said holed disc along said threaded shaft;

said holed disc engaging an inner surface of said reservoir portion for forming a seal therewith;

wherein said holed disc moves towards said head portion when said turn handle is rotated in a first direction with respect to said reservoir portion, said holed disc moving away from said head portion when said turn handle is rotated in a second direction;

a first bristle cover removably coupled to said bristled portion; and said bristled portion of said housing having a peripheral edge, said first bristle cover having a peripheral groove extending around an outer rim thereof, said peripheral groove being adapted for receiving said peripheral edge of said bristled portion for frictionally holding said first bristle cover on said bristled portion;

said reservoir portion having a length of about six and a half inches, said bristled portion having a length of about one inch and a width between about a quarter of an inch and a third of an inch, a distance between said bristled portion being about two inches, said turn handle having an outer diameter about half an inch for aiding in the operation and holding said turn handle; and a refillable toothbrush, comprising:

a housing having a reservoir portion, a head portion detachably coupled to said reservoir portion, a bristled portion detachably coupled to said head portion, and a handle portion rotatably coupled to said reservoir portion;

said bristled portion having a plurality of bristles coupled thereto, said bristled portion may have a plurality of bulbous protuberances extending for detachably attaching said bristled portion to similarly apertures in said head portion of said housing;

said head portion having a tube extending therethrough having an opening in said bristled portion and in communication with said reservoir portion, said toothpaste being forcible through said tube such that a portion of said toothpaste is dispensible onto said bristles;

a cartridge having an open top, an open bottom, toothpaste disposed therein, and an abutment disc positioned towards said bottom and engaging said toothpaste, said cartridge being insertable in said reservoir portion such that said open top is positioned towards said tube of said head portion;

a generally conical resiliently deformable seal member positioned in said tube and engaging said open top of said cartridge for forming a seal between said open top of said cartridge and said seal member, wherein said seal has a bore therethrough for allowing passage of said toothpaste through said seal;

an ejection means for ejecting said toothpaste from said cartridge, said ejection means comprising a plunger slidably positioned in said reservoir portion and engaging said abutment disc of said cartridge, a threaded shaft coupled to said plunger and extending from said reservoir portion into said handle portion through a threaded aperture in said reservoir portion, and a shaft housing fixedly disposed in said handle portion and nonrotatably engaging said threaded shaft, said threaded shaft being slidably positionable along said shaft housing;

wherein said threaded shaft has a pair of lateral flanges extending from said threaded shaft, said shaft housing would have channels running along an inner surface of said shaft housing, said lateral flanges would slide along said channels preventing said threaded shaft from rotating with respect to said shaft housing and said handle portion;

wherein said threaded shaft moves towards said head portion when said handle portion is rotated in a first direction with respect to said reservoir portion, said threaded shaft moving away from said head portion when said handle portion is rotated in a second direction;

a friction ring positioned between said handle portion and said reservoir portion for resisting rotation of said handle portion with respect to said reservoir portion;

a second bristle cover removably coupled to said bristled portion; and said bristled portion of said housing having a peripheral edge, said second bristle cover having a peripheral groove extending around an outer rim thereof, said peripheral groove being adapted for receiving said peripheral edge of said bristled portion for frictionally holding said second bristle cover on said bristled portion.

* * * * *